US005513610A

United States Patent [19]

Okamoto et al.

[11] Patent Number: 5,513,610

[45] Date of Patent: May 7, 1996

[54] IDLE SPEED CONTROL DEVICE FOR AN ENGINE

[75] Inventors: Akio Okamoto, Takahama; Hirohisa Kishi, Nagoya, both of Japan

[73] Assignee: Toyota Jidosha Kabushiki Kaisha, Toyota, Japan

[21] Appl. No.: 423,445

[22] Filed: Apr. 19, 1995

[30] Foreign Application Priority Data

Apr. 26, 1994 [JP] Japan ..... 6-088517

[51] Int. Cl.[6] ..... F02M 3/00

[52] U.S. Cl. ..... 123/339.15

[58] Field of Search ..... 123/339.15, 585, 123/586, 587, 588, 589; 251/129.09, 129.11, 129.15, 129.17

[56] References Cited

U.S. PATENT DOCUMENTS

| | | | |
|---|---|---|---|
| 4,873,954 | 10/1989 | Codling | 123/339.15 |
| 4,909,213 | 3/1990 | Mezger et al. | 123/339.15 |
| 5,080,061 | 1/1992 | Nishimura | 123/339.15 |

FOREIGN PATENT DOCUMENTS

| | | | |
|---|---|---|---|
| 58-27831 | 2/1983 | Japan | 123/339.15 |
| 3-57857 | 3/1991 | Japan | 123/339.15 |

*Primary Examiner*—Raymond A. Nelli
*Attorney, Agent, or Firm*—Oliff & Berridge

[57] ABSTRACT

The idle speed control device according to the present invention controls a two-solenoid rotary type idle speed control valve properly even when one of the solenoids fails. When one of the solenoids fails, the device calculates the amount of bypass air from the amount of inlet air and the degree of opening of the throttle valve, and estimates the degree of opening of the idle speed control valve. If the degree of opening of the bypass valve is larger than that of the neutral valve position, the device sets the duty ratio of the control signal for driving the idle speed control valve at 0%, and if the degree of opening of the idle speed control valve is less than that of the neutral valve position, the device sets the duty ratio of the control signal at 100%. By this control, the two-solenoid rotary type idle speed control valve is maintained at neutral valve position without determining the type of the failure of the solenoids precisely.

6 Claims, 10 Drawing Sheets

Fig. 8

| CASE | FAILED TERMINAL | TYPE OF FAILURE | VOLTAGE AT MONITORING POINT | DEGREE OF OPENING OF IDLE SPEED CONTROL VALVE | REQUIRED EMERGENCY CONTROL |
|---|---|---|---|---|---|
| 1 | RSO | GND SHORT-CIRCUITING | 0 | N ~ O | DECREASE DR |
| 2 | RSO | DISCONNECTION | 0 | C ~ N | INCREASE DR |
| 3 | RSO | SOURCE SHORT-CIRCUITING | BATTERY | C ~ N | INCREASE DR |
| 4 | RSC | GND SHORT-CIRCUITING | 0 | C ~ N | INCREASE DR |
| 5 | RSC | DISCONNECTION | 0 | N ~ O | DECREASE DR |
| 6 | RSC | SOURCE SHORT-CIRCUITING | BATTERY | N ~ O | DECREASE DR |

C···FULLY CLOSED
N···NEUTRAL
O···FULLY OPEND

IDLE SPEED CONTROL DEVICE FOR AN ENGINE

BACKGROUND OF THE INVENTION

1. Field of the Invention

The present invention relates to an idle speed control device for an engine which is equipped with an idle speed control valve for controlling the engine speed during an idle operation. More specifically, the present invention relates to an idle speed control device utilizing a two-solenoid rotary type idle speed control valve and is capable of maintaining the engine idle speed within an appropriate range even when one of the solenoids fails.

2. Description of the Related Art

An idle speed control device is used for maintaining the engine speed at a predetermined target value during the idle operation regardless of changes in engine temperature and engine load. The idle speed control device is usually equipped with an inlet air bypass passage connecting the portions of the inlet air passage upstream and downstream of the throttle valve, and an idle speed control valve for controlling the airflow passing through the inlet air bypass passage. The idle speed control device adjusts the engine speed by controlling the amount of the inlet air supplied to the engine using the idle speed control valve regardless of the degree of opening of the throttle valve during the engine idle operation.

Usually, a stepper motor is used for the actuator of the idle speed control valve and the degree of opening of the idle speed control valve is controlled by adjusting the driving pulse signal supplied to the stepper motor. Therefore, when a failure of the field coil in any phase of the motor occurs, such as a disconnection or ground of the coil, the engine idle speed cannot be controlled precisely.

Japanese Unexamined Patent Publication (Kokai) No. 3-57857 discloses a control device for a stepper motor which can control the motor even when the winding of one of the phases of the motor is failed. The device in JPP '857 detects the failure of the windings of the motor from the control signal of the drive transistors connected to the windings of the respective phases. When a failure of the winding of one of the phases occurs, the device cuts off the supply of the drive pulse to the failed winding and controls the motor using the remaining windings. The device in JPP '857 maintains the operation of the stepper motor at a nearly normal level when one of the windings fails by supplying the drive pulse to only the remaining windings.

An idle speed control valve having an actuator other than a stepper motor, such as a two-solenoid rotary type idle speed control valve, is also used for an idle speed control device. The two-solenoid rotary type idle speed control valve has two solenoids for controlling the degree of opening of the valve. In the two-solenoid rotary type idle speed control valve, when electric current is supplied to the solenoids, one of the solenoids urges the idle speed control valve to open, and the other solenoid urges the idle speed control valve to close. The degree of opening of the idle speed control valve is controlled by adjusting electric current supplied to the two solenoids in such a manner that the force urging the valve to open and the force urging the valve to close are balanced at a desired valve position. The two-solenoid rotary type idle speed control valve has advantages compared with the stepper motor type idle speed control valve in that it has simpler construction and quicker response.

However, the two-solenoid rotary type idle speed control valve has also the disadvantage that the valve may be maintained at a fully opened position or fully closed position when one of the solenoids fails. For example, when the closing solenoid is disconnected, the valve is maintained at the fully opened position when the opening solenoid is activated. On the other hand, when the opening solenoid is disconnected, the valve is maintained at the fully closed position when the closing solenoid is activated. Therefore, if one of the solenoids fails, the idle speed of the engine may become excessively high (when the valve is maintained at the fully opened position), or excessively low (when the valve is maintained at the fully closed position), and the latter may cause a stall of the engine.

Further, the stepper motor can be operated in a nearly normal manner without changing its control method according to the type of the failure of solenoid. As stated in JPP '857, the stepper motor can be controlled substantially normally even when one of the windings fails, by activating the remaining windings in a manner similar to their normal operation regardless of the type of the failure of the winding, i.e., regardless of whether the winding has been disconnected or short-circuited.

In the two-solenoid rotary type idle speed control valve, the operation of the valve is completely different depending on the type of failure of the solenoid as explained later in detail. Therefore, in order to prevent excessively high idle speed or an engine stall caused by excessively low idle speed, the control mode of the remaining solenoid must be changed according to the type of the failure of the other solenoid. However, since it is difficult to exactly determine the type of failures of the solenoid in some cases, it is difficult to control the two-solenoid rotary type idle speed control valve properly when one of the solenoids fails.

SUMMARY OF THE INVENTION

In view of the above problems in the related art, the object of the present invention is to provide a means for controlling an idle speed control device equipped with a two-solenoid rotary type idle speed control valve properly, without determining the type of failure when one of the solenoids fails.

According to one aspect of the present invention, there is provided an idle speed control device for an engine having an inlet air passage and a throttle valve disposed thereon comprising an inlet air bypass passage connecting the portions of the inlet air passage upstream and downstream of the throttle valve for supplying inlet air to the engine without passing through the throttle valve, a two-solenoid rotary type idle speed control valve disposed on the inlet air bypass passage having an opening solenoid for urging the valve to open and a closing solenoid for urging the valve to close, a bypass air control means for controlling the opening of the idle speed control valve by adjusting the electric current supplied to the opening solenoid and the closing solenoid in such a manner that the idle speed of the engine becomes a predetermined target speed, a failure detecting means for detecting a failure of the solenoids, a bypass air flow detecting means for detecting the amount of air flowing through the air bypass passage when a failure of the either of the solenoids is detected, and an emergency control means for maintaining the opening of the idle speed control valve within a predetermined range when one of the solenoids fails, by adjusting the electric current supplied to the other solenoid in accordance with the amount of air flow detected by the bypass air flow detecting means.

Further, according to another aspect of the present invention, there is provided an idle speed control device for an engine having an inlet air passage and a throttle valve disposed thereon, comprising, an inlet air bypass passage connecting the portions of the inlet air passage upstream and downstream of the throttle valve for supplying inlet air to the engine without passing through the throttle valve, a two-solenoid rotary type idle speed control valve disposed on the inlet air bypass passage having an opening solenoid for urging the valve to open and a closing solenoid for urging the valve to close, a bypass air control means for generating a control signal which controls the degree of opening of the idle speed control valve in such a manner that the idle speed of the engine becomes a predetermined target speed, a drive means for driving the idle speed control valve by supplying electric current to the opening solenoid and the closing solenoid in accordance with the control signal, a failure detecting means for detecting a failure of the solenoids, a bypass air flow detecting means for detecting the amount of air flowing through the air bypass passage when a failure of either of the solenoids is detected, and an emergency control means for controlling the bypass air control means when one of the solenoids fails in such a manner that the bypass air control means generates the control signal in accordance with the amount of air flow detected by the bypass air flow detecting means.

BRIEF DESCRIPTION OF THE DRAWINGS

The present invention will be better understood from the description as set forth hereinafter, with reference to the accompanying drawings, in which:

FIG. 8 shows a table explaining the types of failures of a solenoid in a two-solenoid rotary type idle speed control valve;

DESCRIPTION OF THE PREFERRED EMBODIMENT

Figure 1:
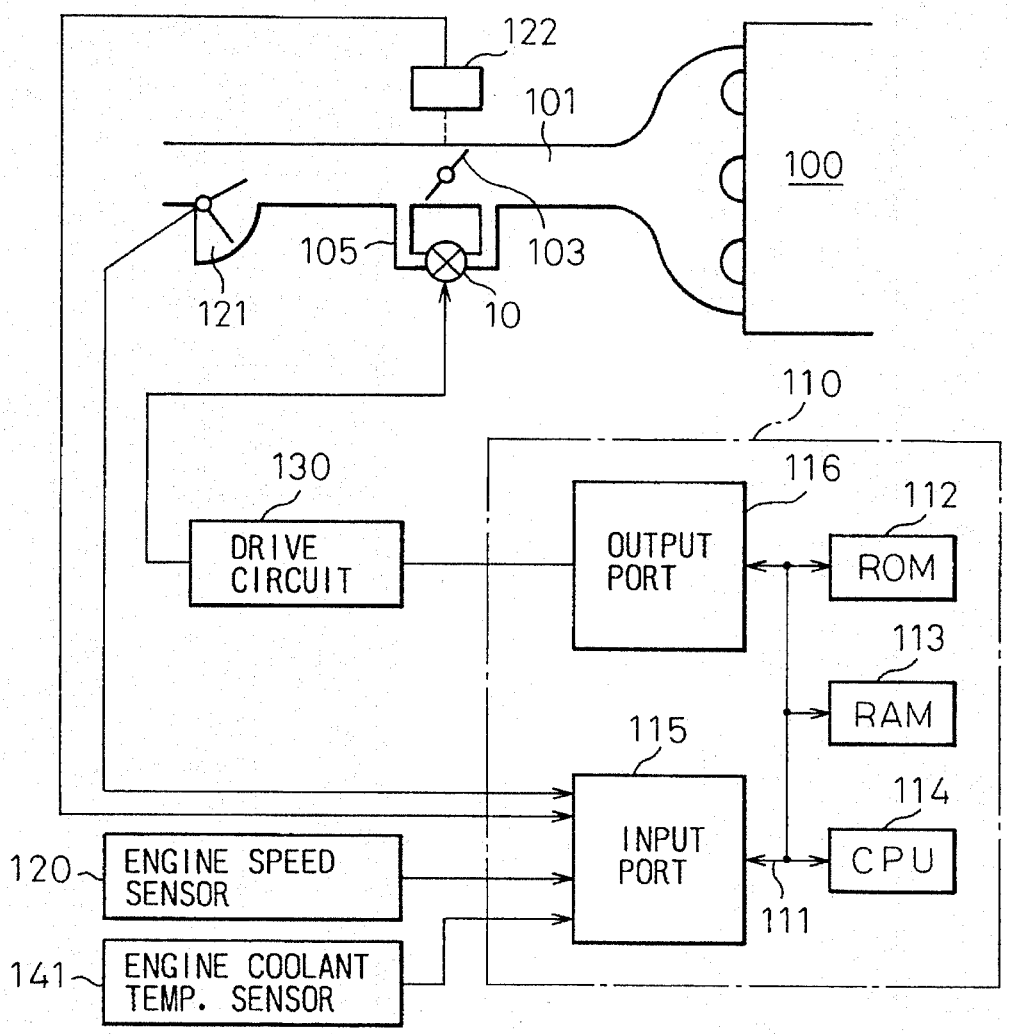
FIG. 1 is a drawing schematically illustrating an embodiment of the idle speed control device according to the present invention.

FIG. 1 schematically illustrates an embodiment of the idle speed control device applied to an automobile engine. In FIG. 1, numeral 100 designates an internal combustion engine, 101 and 103 designate an inlet air passage of the engine 100 and a throttle valve disposed on the inlet air passage 101, respectively. In this embodiment, an air bypass passage 105 which connects the portions of the inlet air passage upstream and downstream of the throttle valve 103 is provided. On the air bypass passage 105, an idle speed control valve 10 of a two-solenoid rotary type is disposed. During an idle operation and a low load operation of the engine 100, the amount of inlet air supplied to the engine is controlled by adjusting the amount of bypass air supplied through the air bypass passage 105 by adjusting the degree of opening of the idle speed control valve 10.

Numeral 110 in FIG. 1 designates an engine control unit (ECU) of the engine 100. In this embodiment, the ECU 110 consists of a microcomputer which comprises a read-only-memory (ROM) 112 for storing routines , a random-access-memory (RAM) 113 for storing temporary data, a central processing unit (CPU) 114, an input port 115, an output port 116, and a bi-directional bus 111 for connecting the CPU 114, the ROM 112, the RAM 113 and the input and output ports 115, 116 to each other. The ECU 110 performs basic controls of the engine 100 such as fuel injection control and engine speed control. In this embodiment, the ECU 110 further performs idle speed control of the engine 100 in which the engine speed during the idle operation (i.e., the operation of the engine in which the degree of opening of the throttle valve is less than a predetermined value) is maintained at a predetermined target value by adjusting the amount of inlet air flow using the idle speed control valve 10. Further, the ECU 110 detects failures of the solenoids of the idle speed control valve 10 and performs an emergency control of the idle speed control valve 10 when one of the solenoids fails in order to maintain the degree of opening of the idle speed control valve 10 at a predetermined value by activating the solenoid which has not failed. The emergency control of the idle speed control valve 10 is explained later in detail.

To perform these controls, various signals representing the engine operating condition are supplied to the input port 115 of the ECU 110. These signals are, for example, an engine speed signal from an engine speed sensor 120 disposed on the ignition distributor (not shown) which represents the rotational speed of the engine 100, an air flow signal from an airflow meter 121 disposed on the inlet air passage upstream of the junctions of the air bypass passage 105 which represents the amount of inlet air flow, a throttle signal from a throttle sensor 122 provided on the throttle valve 103 which represents the degree of opening of the throttle valve 103.

Figure 2:
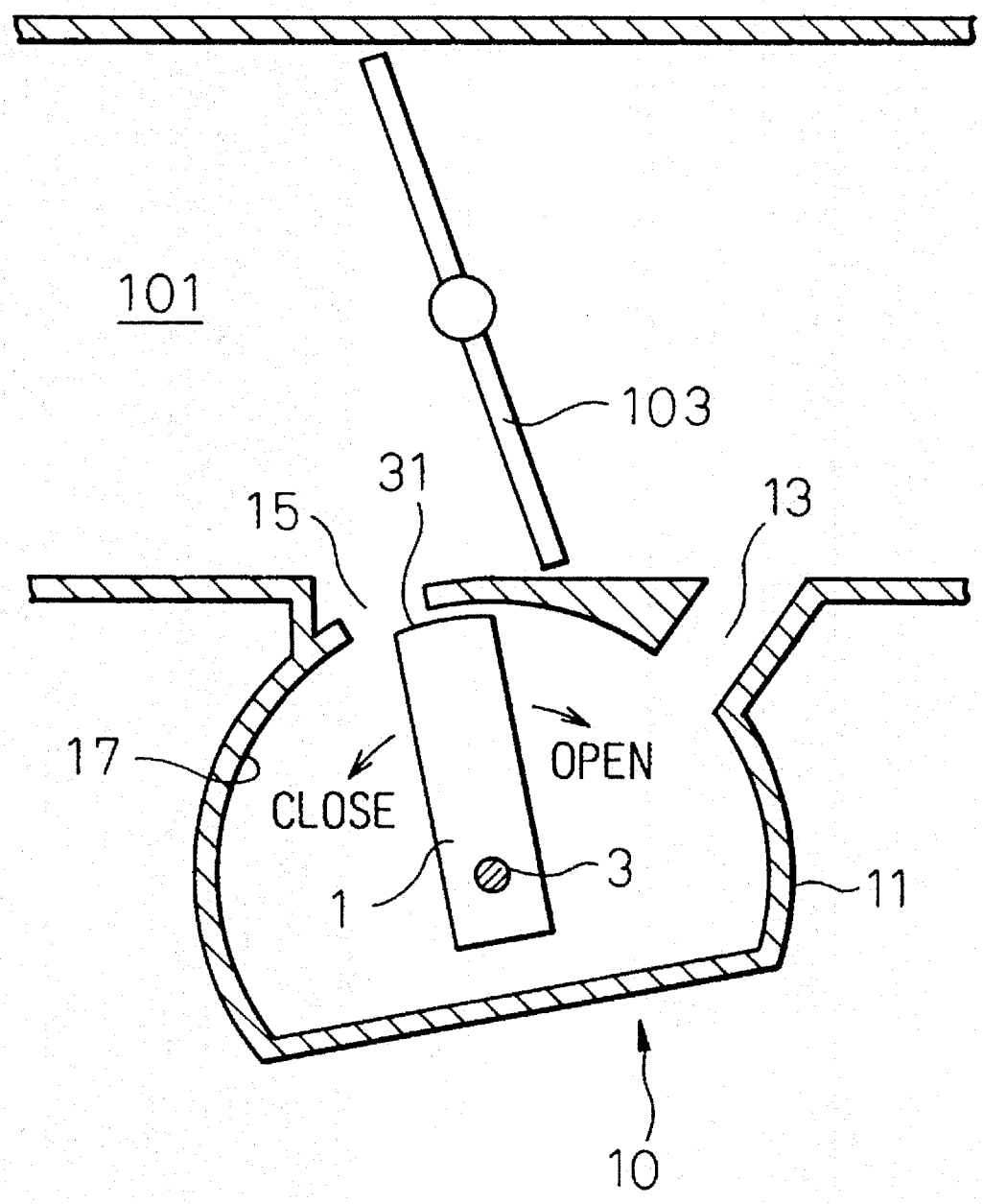
FIG. 2 is a drawing schematically showing a typical construction of a two-solenoid rotary type idle speed control valve.

FIG. 2 schematically illustrates a typical construction of the two-solenoid rotary type idle speed control valve which is used for the idle speed control valve 10 in this embodiment. In FIG. 2, numeral 11 designates a housing of the idle speed control valve 10 secured to the wall of the inlet air passage 101 at the portion of throttle valve 103. Numerals 13 and 15 in FIG. 2 designate an inlet port and an outlet port of the housing 11, respectively. The inlet port 13 connects the inside of the housing 11 to the portion of the inlet air passage 101 upstream of the throttle valve 103, and the outlet port 15 connects the inside of the housing 11 to the portion of the inlet air passage 101 downstream of the throttle valve 103. Namely, the inlet port 13, housing 11 and outlet port 15 in FIG. 2 form the air bypass passage 105 in FIG. 1.

Figure 3:
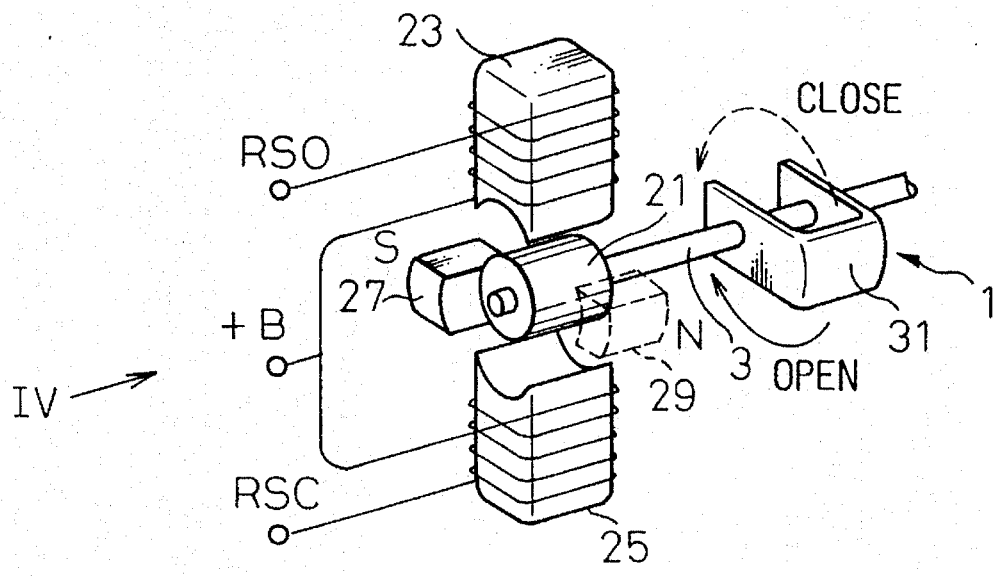
FIG. 3 is a drawing illustrating the drive mechanism of a two-solenoid rotary type idle speed control valve.

In the housing 11 of the idle speed control valve 10, a valve body 1 is disposed. The valve body 1 is formed by bending a piece of metal into a U-shape, as shown in FIG. 3. A drive shaft 3 penetrating the portions of the valve body corresponding to two vertical sides of the U-shape is provided to turn the valve body 1 around the axis thereof. The housing 11 is formed in the shape of a cylinder split by a plane parallel to the center axis thereof. The drive shaft 3 of the valve body 1 further penetrates the housing in a direction parallel to the center axis of the housing 11. A portion 31 of the valve body 1 which corresponds to the horizontal part of the U-shape maintains a slide contact with the circular inner periphery 17 of the housing 11 when the valve body 1 is turned by the drive shaft 3. The inlet port 13 and the outlet port 15 open on the circular inner periphery 17 of the housing 11. When the valve body 1 is turned by the drive shaft 3, the portion 31 of the valve body 1 covers the opening of the outlet port 15 on the inner periphery 17 of the housing 11. Therefore, the opening area of the outlet port 15 can be adjusted by turning the valve body 1 by activating the solenoids disposed around the drive shaft 3, as explained later. Thus, the amount of air passing through the idle speed control valve 10, i.e., the amount of air by-passing the throttle valve 103 can be controlled by turning the drive shaft 3.

FIG. 3 illustrates a drive mechanism for turning the drive shaft 3 of the idle speed control valve 10. In FIG. 3, numeral 21 shows a cylindrical permanent magnet attached to the drive shaft 3, numerals 23 and 25 designate drive solenoids facing the cylindrical surface of the permanent magnet 21. Further, permanent magnets (or alternatively, metal pieces) 27, 29 for determining a neutral valve position are secured to the housing 11 at the positions facing the cylindrical surface of the permanent magnet 21. As shown in FIG. 3, the windings of the drive solenoids 23 and 25 have directions opposite to each other. The ends of the winding of the respective solenoids facing the permanent magnet 21 are connected to a positive terminal of a battery via a common terminal B. The other end of the winding of the solenoid 23 is connected to a collector of a transistor via a terminal RSO in FIG. 3. Similarly, the other end of the winding of the solenoid 25 is connected to a collector of another transistor via a terminal RSC in FIG. 3. When electricity is fed to the solenoids 23 and 25, the solenoid 23 and solenoid 25 have polarities opposite to each other (for example, when the circuit is charged, the ends facing the permanent magnet 21 of both the solenoids 23 and 25 become N-poles in FIG. 3).

Figure 4:
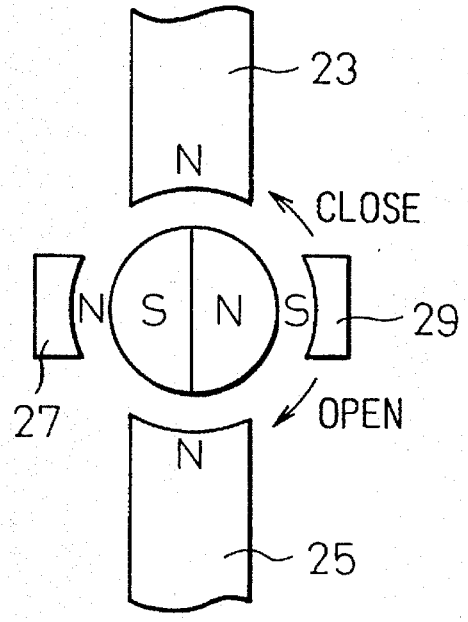
FIG. 4 is a drawing illustrating relative positions of the elements shown in FIG. 3.

FIG. 4 shows the relative positions of the permanent magnet 21, drive solenoids 23, 25, and the permanent magnets 27, 29 for neutral valve position when viewed along the direction of the arrow IV in FIG. 3. As shown in FIG. 4, the permanent magnet 21 has a N-pole on one side of the plane including the center axis, and a S-pole on the other side of said plane.

As explained before, the ends of both the drive solenoids 23 and 25 facing the permanent magnet 21 have the same polarity (i.e., N-poles in FIGS. 3 and 4) when the drive circuits of both the solenoids 23 and 25 are charged. Therefore, for example, when the solenoid 23 is activated in FIGS. 3 and 4, a clockwise torque is exerted on the permanent magnet 21, and a counterclockwise torque is exerted on the permanent magnet 21 when the solenoid 25 is activated. Further, if both the solenoids 23 and 25 are activated simultaneously, the permanent magnet 21 is held at the position where the electromagnetic forces of the solenoids 23 and 25 balance each other.

In this embodiment, when the permanent magnet 21 (and the drive shaft 3 connected thereto) turns counterclockwise in FIG. 4, the valve body 1 of the idle speed control valve 10 is turned by the drive shaft 3 to the direction that increases the opening area of the outlet port 15. When the permanent magnet 21 turns clockwise, the valve body 1 turns to the direction that increases the opening area of the outlet port 15. Therefore, by adjusting the electric current supplied to the drive solenoids 23 and 25, the opening area of the outlet port 15 and hence the amount of air passing through the outlet port can be controlled. In this specification, the drive solenoid 23 which drives the valve body 1 to the direction that opens the outlet port is called an opening solenoid (or SCO), and the drive solenoid 25 which drives the valve body 1 to the direction that closes the outlet port 15 is called a closing solenoid (or SCC).

The permanent magnets 27 and 29 for determining the neutral position of the valve body 1 are disposed in such a manner that the ends thereof having opposite polarities (in FIG. 4, the N-pole end of the magnet 27 and the S-pole end of the magnet 29) face the permanent magnet 21. Therefore, when both the opening solenoid 23 and the closing solenoid 25 are activated at the same time by the same amount of electric current, or when both the opening solenoid 23 and closing solenoid 25 are deactivated at the same time, the electromagnetic forces of the solenoids 23 and 25 cancel each other, and the valve body 1 is held at the neutral position determined by the positions of the permanent magnet 27 and 29. In this embodiment, the neutral valve position is selected in such a manner that the amount of bypass air passing through the idle speed control valve 10 is maintained in an appropriate range which does not cause an excessively high or low idle speed of the engine.

Figure 5:
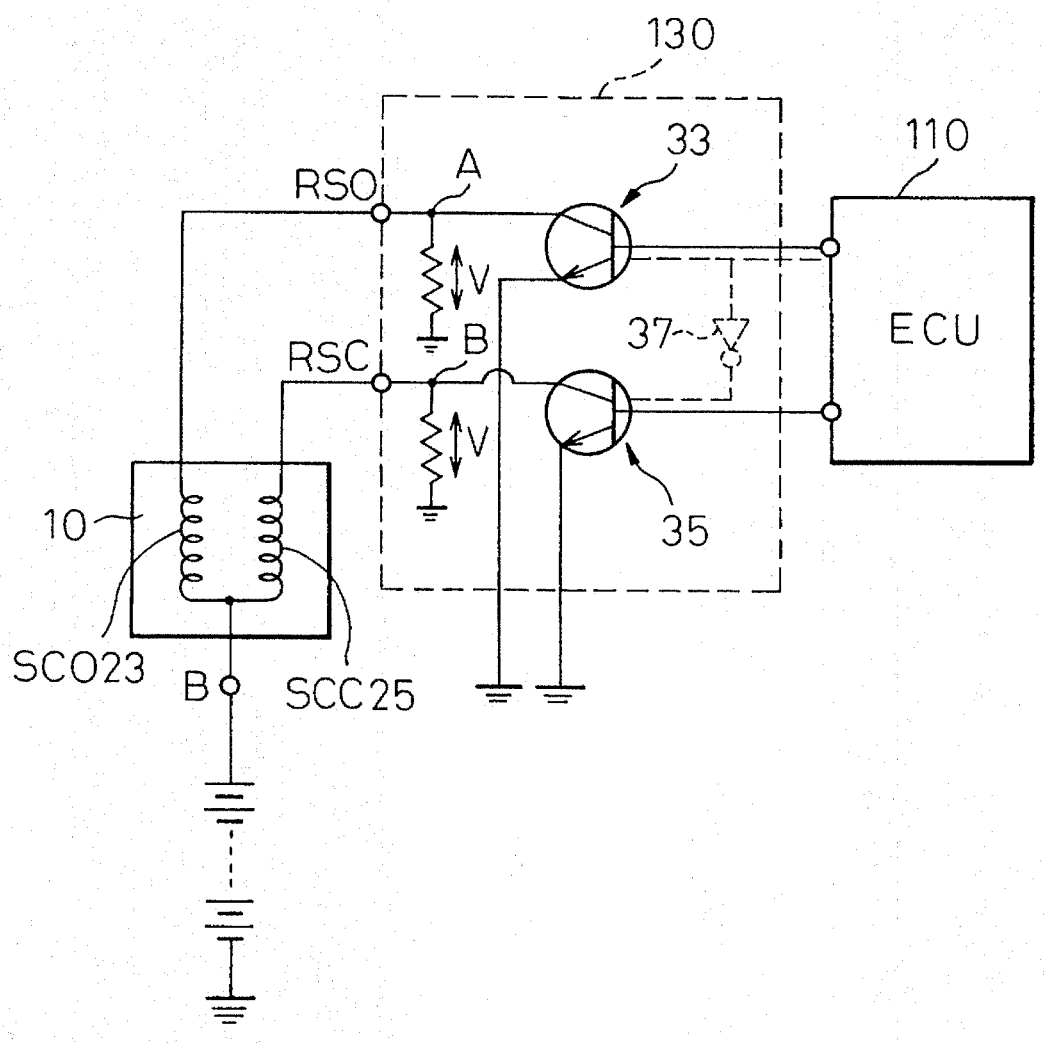
FIG. 5 is a circuit diagram of the drive circuit for the drive mechanism in FIG. 3.

FIG. 5 shows the circuit diagram of the drive circuit 130 of the idle speed control valve 10. In FIG. 5, the terminal RSO of the opening solenoid (SCO) 23 and the terminal RSC of the closing solenoid (SCC) 25 are connected to the collectors of the switching transistors 33 and 35, respectively. The bases of the transistors 33 and 35 are connected to the output port 116 of the ECU 110 to receive control pulse signals. The emitters of the transistors 33 an 35 are grounded.

When the control signals from the ECU 110 are fed to the bases of the transistors 33 and 35 (i.e., when the control signals are OFF), electric current is supplied to the opening solenoid (SCO) 23 and the closing solenoid (SCC) 25 from the battery. When the control signals from the ECU 110 is OFF, the transistors 33 and 35 are turned off, and the electric current from the battery is stopped.

Figure 6:
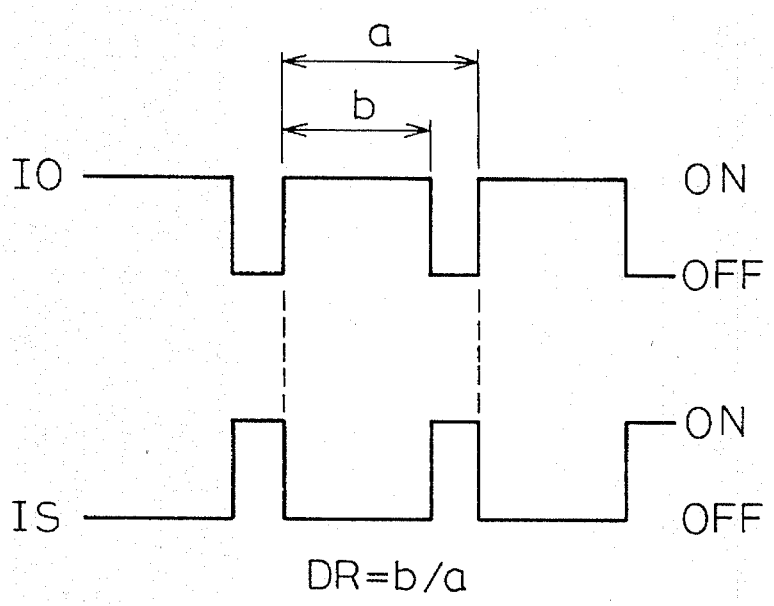
FIG. 6 is a diagram explaining the duty ratio of the control signal supplied to the drive circuit in FIG. 5.

In this embodiment, electric current supplied to the opening solenoid 23 and closing solenoid 25 are controlled by changing the duty ratio of the control pulse signal from the ECU 110. FIG. 6 is a timing diagram illustrating the definition of the duty ratio of the control signal generated by the ECU 110 used in the present embodiment. In FIG. 6, IO designates the signal supplied to the transistor 33 of the opening solenoid 23 from the ECU 110, and IS designates the signal supplied to the transistor 35 of the closing solenoid 35. As shown in FIG. 6, the signals IO and IS are controlled in such a manner that IO and IS always have opposite phases, i.e., when the IO is on, the IS is off, and vice versa.

The duty ratio DR used in this embodiment is defined as DR=b/a where b is a length that the IO is ON and a is a length of one cycle of the pulse of the IO signal. Since the phases of the IO signal and the IS signal are always opposite, when the duty ratio DR of the control signal increases, the average current supplied to the opening solenoid (SCO) 23 increases, and the average current supplied to the closing solenoid (SCC) 25 decreases. This causes the degree of opening of the idle speed control valve 10 to increase. When the duty ratio DR of the control signal decreases, the average current supplied to the opening solenoid (SCO) 23 decreases, and the average current supplied to the closing solenoid (SCC) 25 increases, thus the degree of opening of the idle speed control valve 10 decreases. Therefore, the amount of air flowing through the idle speed control valve 10 can be controlled by changing the duty ratio DR of the control signal.

Though the opening solenoid 23 and closing solenoid 25 are controlled by separate control signals IO and IS in this embodiment, the opening solenoid 23 and the closing solenoid 25 can be controlled by a single control signal using an inverter 37 as shown by dotted lines in FIG. 5. In this case, the ECU 110 generates only one control signal (in FIG. 5, the IO signal), and this control signal is supplied directly to one of the transistors (in FIG. 5, the transistor 33) while supplied to the other transistor (in FIG. 5, the transistor 35) after being reversed by the inverter 37. By this arrangement, the idle speed control valve 10 can be controlled by one control signal.

Figure 7:
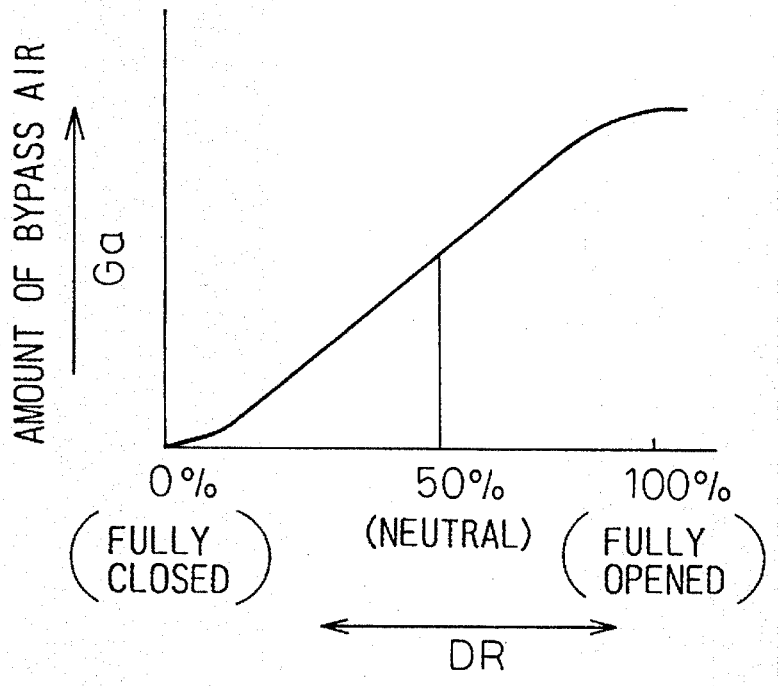
FIG. 7 shows an example of the flow characteristics of a two-solenoid rotary type idle speed control valve.

FIG. 7 shows an example of the relationship between the duty ratio DR of the control signal and the amount of air flowing through the idle speed control valve 10 (i.e., bypass air flow rate Ga). As seen from FIG. 7, the flow rate of bypass air can be controlled precisely by controlling the opening solenoid 23 and closing solenoid 25 using a single parameter DR.

In this embodiment, the ECU 110 performs an idle speed control of the engine when the degree of opening of the throttle valve 103 is less than a predetermined value (i.e., the engine is operated in the idle condition or low load condition). In the idle speed control, the position of the idle speed control valve 10 is feedback controlled by adjusting the duty ratio DR of the control signals in such a manner that the engine speed detected by the engine speed sensor 120 coincides with the predetermined target value. However, since the position of the idle speed control valve 10 is determined by the balance of the electromagnetic forces generated by the opening solenoid 23 and the closing solenoid 25, when one of the solenoids 23 and 25 fails, the idle speed control valve 10 cannot be controlled properly, thus the engine speed cannot be maintained at the target value and sometimes becomes excessively high or low. To prevent this problem from occurring, the ECU 110 performs an emergency control of the idle speed control valve 10 in order to maintain the engine speed in an appropriate range when one of the solenoids fails.

In the two-solenoid rotary type idle speed control valve, the movement of the idle speed control valve is completely different depending on the type of the failure of the solenoids. Therefore, when one of the solenoids fails, it is necessary to control the idle speed control valve in accordance with the type of the failure of the solenoids in order to maintain the engine speed in an appropriate range. In this embodiment, a failure of the solenoids is detected by monitoring the voltages of the points A and B shown in FIG. 5. However, it is difficult to determine the type of the failure of the solenoids precisely based on the voltages measured at the points A and B. This problem is explained with reference to FIG. 8.

FIG. 8 shows the types of failures of the solenoids and the movements of the idle speed control valve 10 when such failures occur. FIG. 8 shows an example in which the failures occur at the terminals RSO or RSC of the solenoids at which the failures are most possible. However, when the failure occurs at other portions of the solenoid circuits, the phenomena are similar to those shown in FIG. 8.

Generally, following three types of failures are possible at the terminals RSO and RSC:

(1) a grounding of the terminal (a ground short-circuiting);

(2) a disconnection or a breakage of the terminal;

(3) a short-circuiting of the terminal to the battery (a source short-circuiting).

When a ground short-circuiting occurs, the terminal RSO or RSC are electrically connected to the negative terminal of the battery through the ground and electric current continuously flows through the solenoid connected to the failed terminal regardless of the control signals. On the other hand, when a disconnection or a source short-circuiting occurs, electric current is not supplied to the solenoids regardless of the control signals. Further, when a ground short-circuiting or a disconnection of the terminal occurs, both the voltages measured at the points A and B become zero. When a source short-circuiting occurs, both the voltages measured at the points A and B becomes the same as the output voltage of the battery.

When the solenoids are normal, the voltages measured at the monitoring points A and B oscillates regularly between the battery voltage and zero voltage in accordance with the control signals. When one of the above failures occurs, the voltage of the monitoring points stays at zero voltage (in case of the ground short-circuiting or the disconnection of the terminal) or the battery voltage (in case of the source short-circuiting). Therefore, it is possible to determine whether the failures occur in the solenoids by monitoring the oscillations of the voltages at the monitoring points A and B. However, it is not possible to determine the type of the failures from the voltages of the monitoring points A and B since both the ground short-circuiting and the disconnection of the terminal result in zero voltage at the corresponding monitoring point.

FIG. 8 tabulates the positions at which the idle speed control valve 10 is held in accordance with the places and types of the failures. In FIG. 8, it is assumed that the electric current is supplied to the other (not failed) solenoid in accordance with the control signal from the ECU 110 even when one of the solenoids fails.

In FIG. 8, cases 1 through 3 show the failures of the terminal RSO of the opening solenoid (SCO) 23, and cases 4 through 6 show the failures of the terminal RSC of the closing solenoid (SCC) 25, respectively. For example, case 1 in FIG. 8 shows the ground short-circuiting at the terminal RSO of the opening solenoid (SCO) 23. In this case, the voltage measured at the corresponding monitoring point (point A in FIG. 5) becomes zero, and the idle speed control valve 10 is held at a position somewhere between the neutral position and the fully opened position in accordance with the duty ratio DR of the control signal from ECU 110 (i.e., in accordance with the amount of electric current supplied to the closing solenoid (SCC) 25), since the electric current is supplied to the opening solenoid (SCO) 23 regardless of the duty ratio of the control signal of the ECU 110 when the ground short-circuiting occurs at terminal RSO. (I.e., when the duty ratio DR of the control signal is 100%, the idle speed control valve 10 is held at fully opened position, and when the DR of the control signal is 0%, the idle speed control valve is held at the neutral position. Please note that when the duty ratio DR of the control signal is 100%, no electric current is supplied to the closing solenoid (SCC) 25 as shown in FIG. 6.)

Cases 2 and 3 show the disconnection (case 2) and the source short-circuiting (case 3) at the terminal RSO of the opening solenoid (SCO) 23, respectively. Though the voltage at the monitoring point A is different (i.e., zero in case 2 and the battery voltage in case 3), the idle speed control valve 10 is held at the position somewhere between fully closed position (when the duty ratio DR of the control signal is 0%), and the neutral position (when DR is 100%) in these cases, since the supply of the electric current to the opening solenoid (SCO) 23 is stopped in these cases.

When the failure occurs at the terminal RSC of the closing solenoid (SCC) 25, the idle speed control valve 10 is also held at the position in accordance with the types of the failure as shown by cases 4 through 6 in FIG. 8.

Please note that though in the cases 1, 2 and 4, 5, respectively, the voltage at the monitoring points are the same (i.e., zero voltage), the idle speed control valve 10 is held at different positions. Therefore, it is difficult to determine the types of the failures and control the idle speed control valve 10 in accordance with the types of the failures.

However, also please note that in cases 1, 5, 6, the degree of opening of the idle speed control valve 10 becomes always larger than or equal to that of the neutral position. Therefore, in these cases it is possible to obtain the neutral valve position by reducing the degree of opening of the valve 10, i.e., by increasing the electric current flowing through the closing solenoid (SCC) 25 in case 1, and by decreasing the electric current flowing through the opening solenoid (SCO) 23 in cases 5 and 6. This is achieved by decreasing the duty ratio DR of the control signal, because, when the opening solenoid (SCO) fails, the electric current flowing through the closing solenoid (SCC) can be increased by decreasing the duty ratio DR of the control signal, and when the closing solenoid (SCC) fails, the electric current flowing through the opening solenoid (SCO) can be decreased by decreasing the duty ratio DR of the control signal.

Similarly, when the failures of cases 2, 3 and 4 occur, the degree of opening of the idle speed control valve 10 becomes always smaller than or equal to that of the neutral position. Therefore, in the failures of cases 2, 3, and 4, the idle speed control valve 10 can be maintained at the neutral position by decreasing the electric current flowing through the closing solenoid (SCC) 25 in case 2 and by increasing the electric current flowing through the opening solenoid (SCO) 23 in cases 3 and 4, i.e., by increasing the duty ratio DR of the control signal. This means that when the failure of the solenoids occurs, the idle speed control valve 10 can be maintained at the neutral valve position by increasing or decreasing the duty ratio of the control signal in accordance with whether the degree of opening of the valve is larger than (or smaller than) that of the neutral valve position when the failure occurs, i.e., without determining the type of the failure.

In this embodiment, the ECU 110 monitors the voltages at the monitoring points A and B during the engine operation and determines that one of the solenoids has failed if the voltage of one of the monitoring points becomes constant while the voltage of the other monitoring point oscillates. If it is determined that one of the solenoids has failed, the ECU 110 performs an emergency control of the idle speed control valve 10 in which the duty ratio DR is adjusted in accordance with whether the degree of opening of the idle speed control valve 10 is larger (or smaller) than that of the neutral valve position without determining the type of failures.

Figure 9:
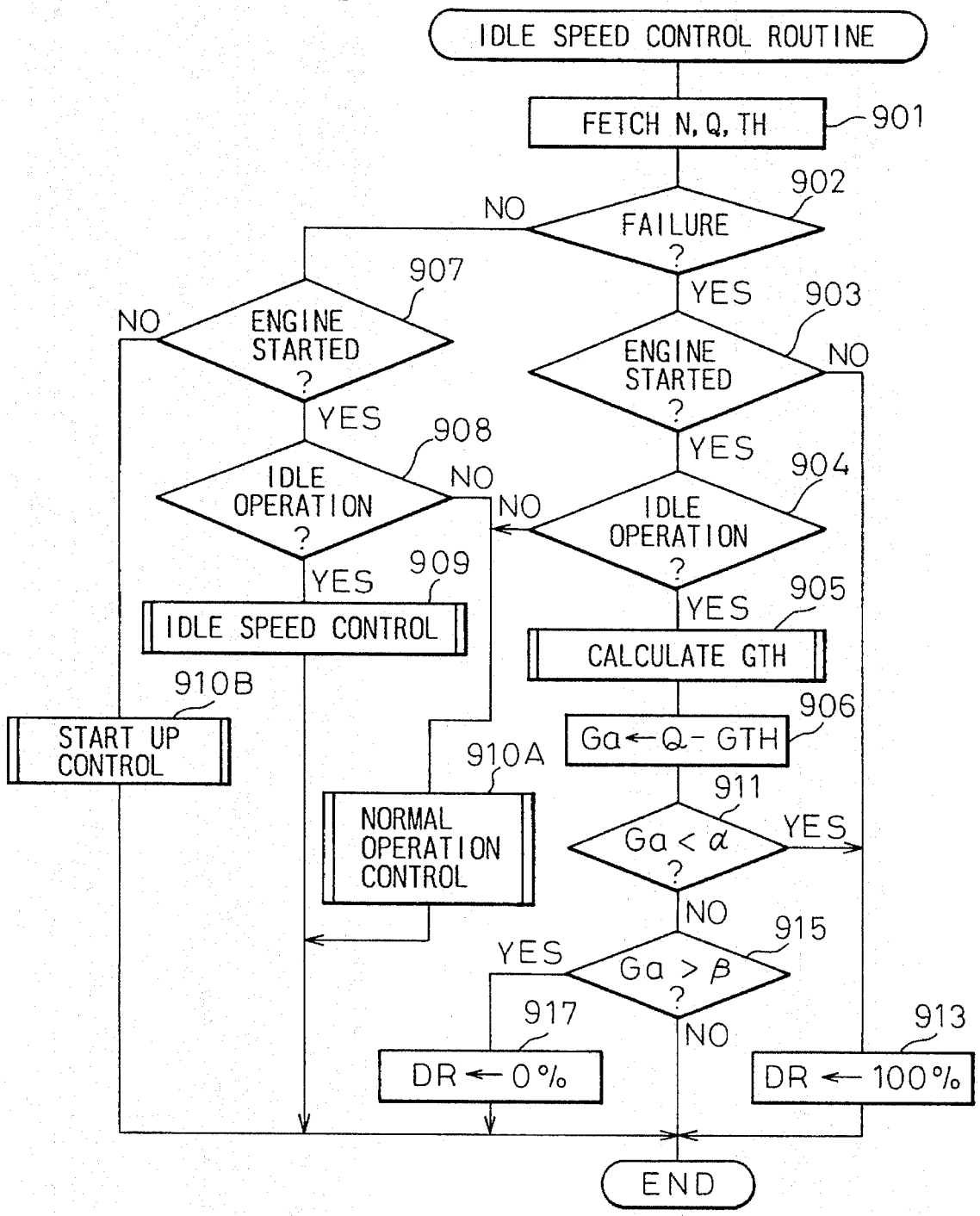
FIG. 9 is a flowchart of the control routine for two-solenoid rotary type idle speed control valve according to an embodiment of the present invention.

FIG. 9 is a flowchart illustrating an embodiment of the emergency control of the idle speed control valve i0. This routine is performed by the ECU 110 at predetermined intervals. When the routine starts in FIG. 9, at step 901, the signals representing the engine speed N, the amount of intake air flow Q and the degree of opening TH of the throttle valve 103 are input from the corresponding sensors 120, 121 and 122. At step 902, it is determined whether a failure of the solenoids has occurred based on the voltages detected at the monitoring points A and B. If both the voltages are oscillating, or if both the voltages are constant, it is determined that both the solenoids are normal. On the other hand, if one of the voltages is constant while the other voltage is oscillating, it is determined that one of the solenoids has failed.

If both the solenoids are determined as normal at step 902, the routine proceeds to step 907 which determines whether the engine has started based on the engine speed N read at step 901. If the engine speed is not higher than a predetermined value (such as 400 rpm), at step 907, it is determined that the engine has not started, i.e., that the cranking of the engine is not completed, and the routine proceeds to step 910B which performs a normal start up control of the idle speed control valve 10. In the normal start up control, the degree of opening of the idle speed control valve 10 is determined in accordance with the engine coolant temperature.

If it is determined that the engine has started at step 907, the routine then proceeds to step 908 in order to determine whether the engine is in idle operation. In this embodiment, it is determined that the engine is in idle operation when the degree of opening TH of the throttle valve is less than a predetermined value. When the engine is in idle operation, the normal idle speed control is performed at step 910A, in which the duty ratio DR of the control signal is feedback controlled in such a manner that the actual engine speed N read at step 901 coincides with a predetermined target value.

At step 902, if it is determined that one of the solenoids has failed, the routine proceeds to step 903 which determines whether the engine has started in the same manner as step 907. If the engine has not started, this routine terminates after setting the duty ratio DR of the control signal at 100% at step 913. The reason why the duty ratio DR is set at 100% is that, if one of the solenoids has failed, the idle speed control valve 10 takes either a fully opened position or the neutral position when the duty ratio DR is set at 100%, therefore, by setting the duty ratio DR at 100%, an amount of inlet air sufficient for starting the engine is supplied to the engine even if one of the solenoids has failed.

If the engine has started at step 903, it is determined that whether the engine is in the idle operation at step 904, and if the engine is not idle operation, the routine proceeds to step 910A. At step 910A, the idle speed control valve 10 is set at a predetermined position suitable for normal load operation of the engine.

If the engine is in the idle operation at step 904, the emergency control of the idle speed control valve 10 is performed by the steps 905 through 917.

In the steps 905 through 915, first, the amount of bypass air is calculated, then the degree of opening of the idle speed control valve 10 is determined based on the amount of bypass air, and the duty ratio DR of the control signal is determined in accordance with the degree of opening of the idle speed control valve 10.

Figure 10:
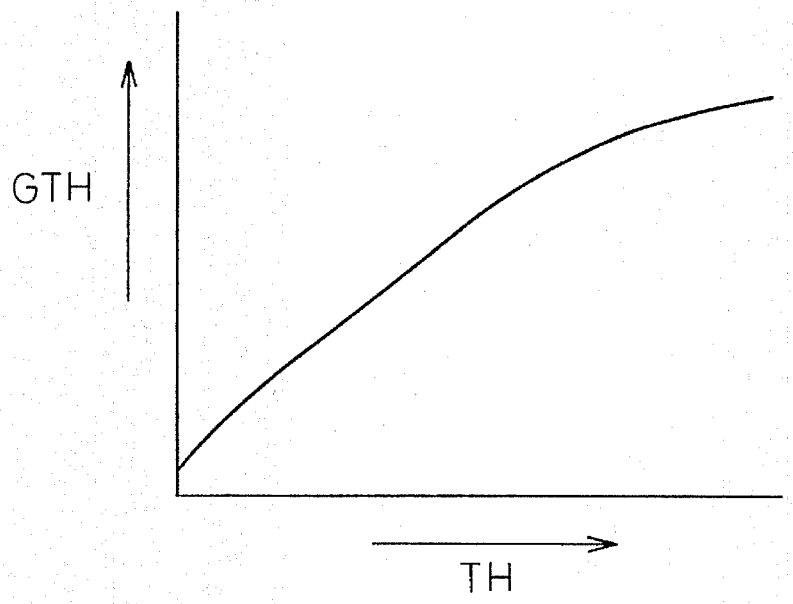
FIG. 10 is a graph showing the typical relationship between the degree of opening of the throttle valve and the amount of inlet air flowing through the throttle valve.

Namely, at step 905, the amount of inlet air GTH passing through the throttle valve 103 is calculated from the degree of opening of the throttle valve. In this embodiment, the relationship between the degree of opening TH of the throttle valve 103 and the amount of inlet air GTH passing therethrough has been obtained previously by experiment, and stored in the ROM 112 of the ECU 110 in the form of a numerical map using the values of TH and GTH. FIG. 10 shows a typical relationship between the values TH and GTH. Since the engine idle speed does not vary widely, the amount of inlet air GTH can be considered as a sole function of the degree of opening TH of the throttle valve. However, the amount of inlet air GTH may be determined as a function of the engine speed N and the degree of opening TH of the throttle valve. In this case the relationship between TH and GTH shown in FIG. 10 is determined previously by experiment at different engine speeds N.

At step 906, the amount of bypass air Ga passing through the idle speed control valve 10 is calculated. The amount of bypass air Ga is calculated as a difference between the total amount of inlet air Q detected by the airflow meter 121 and the amount of inlet air GTH passing through the throttle valve 103.

Then, at step 911, it is determined whether the calculated amount Ga of bypass air is smaller than a predetermined amount $\alpha$. The amount $\alpha$ is selected in such a manner that $\alpha$ is sufficiently smaller than the amount of bypass air when the idle speed control valve 10 is at the neutral position and, at the same time, $\alpha$ is sufficiently larger than the minimum amount of bypass air to prevent an excessively low engine speed.

If $Ga<\alpha$ at step 911, since it is considered that the degree of opening of the idle speed control valve 10 is smaller than that of the neutral position, the duty ratio DR of the control signal is set at 100% at step 913. If the degree of opening of the idle speed control valve 10 is smaller than that of the neutral position, this means that one of the failures in case 2, 3 or 4 in FIG. 8 has occurred. In these failures, when the duty ratio DR is set at 100%, the electric current is supplied continuously to both the opening solenoid (SCO) 23 and the closing solenoid (SCC) 25 (case 4 in FIG. 8), or the electric current is shut off at both the opening solenoid (SCO) 23 and the closing solenoid (SCC) 25 (cases 2 and 3 in FIG. 8). Therefore, the idle speed control valve 10 takes the neutral position.

If $Ga\geqq\alpha$ at step 911, then it is determined whether Ga is larger than the predetermined amount $\beta$. $\beta$ is a value sufficiently larger than the amount of bypass air when the idle speed control valve 10 is at the neutral position, yet still sufficiently smaller than the amount of bypass air causing an excessively high engine idle speed. If $Ga>\beta$ at step 915, since it is considered that the degree of opening of the idle speed control valve 10 is larger than that of the neutral position, the duty ratio DR of the control signal is set at 0% at step 917. If the degree of opening of the idle speed control valve 10 is larger than that of the neutral valve position, this means that a failure of case 1, 5 or 6 in FIG. 8 has occurred. In these failures, by setting the duty ratio DR of the control signal at 0%, the electric current is supplied continuously to both the opening solenoid (SCO) 23 and the closing solenoid (SCC) 25 (case 1 in FIG. 8), or the electric current is shut off at both the opening solenoid (SCO) 23 and the closing solenoid (SCC) 25 (cases 5 and 6 in FIG. 8). Namely, the idle speed control valve 10 takes the neutral position also in this case.

If $\alpha\leqq Ga\leqq\beta$ at steps 911 and 915, the routine terminates without changing the duty ratio DR of the control signal. Therefore, the duty ratio DR is maintained at the same value as the value when the routine was last performed (i.e., 0% or 100%).

According to the present embodiment, the idle speed control valve 10 is securely held at neutral position even when one of the solenoids has failed. Therefore, the engine idle speed is maintained within an appropriate range. Further, it is not necessary to determine the type of failure of the solenoid precisely to control the idle speed control valve in case of a failure.

Next, another embodiment of the present invention is explained with reference to FIGS. 11 through 14. In the embodiment explained above, the idle speed control valve is controlled in such a manner that the valve is always held at the neutral position when a failure of the solenoids occurs. This causes the amount Ga of bypass air to be maintained constant regardless of the engine operating conditions. However, the optimum amount of bypass air varies in accordance with the operating condition of the engine such as the engine warming up conditions. Therefore, it is preferable to control the amount Ga of bypass air even when a failure of the solenoids has occurred in such a manner that the amount Ga of bypass air approaches the optimum amount determined by the operating condition of the engine.

In this embodiment, the degree of opening of the idle speed control valve is changed even when the failure of the solenoids has occurred in accordance with the operating conditions of the engine in order to keep the amount of bypass air as near to the optimum amount as possible. For example, when the engine coolant temperature is low, the optimum amount of bypass air is larger than the amount of bypass air at the neutral position of the idle speed control valve. Therefore, it is preferable to set the degree of opening of the idle speed control valve larger than that of the neutral valve position also when a failure of the solenoids has occurred. On the contrary, if the engine coolant temperature is sufficiently high, it is preferable to set the degree of opening of the idle speed control valve smaller than that of the neutral valve position. Since the engine coolant temperature gradually increases after the engine starts, the optimum amount of bypass air gradually decreases after the engine starts.

Further, if a failure of the case 1, 5 or 6 in FIG. 8 occurs, it is possible to control the position of the idle speed control valve within the range between the neutral valve position and the fully opened position by adjusting the duty ratio DR of the control signal though it is not possible to maintain the position of the idle speed control valve between the neutral position and the fully closed position. On the contrary, if a failure of the cases 2, 3 and 4 in FIG. 8 occurs, it is possible to control the idle speed control valve within the range between the fully closed position and the neutral position though it is not possible to maintain the position of the valve between the neutral position and the fully opened position. Since the optimum amount of bypass air gradually decreases after engine starts, the optimum degree of opening of the idle speed control valve also gradually decreases after the engine starts.

In this embodiment, if a failure of the case 1, 5 or 6 in FIG. 8 occurs, the degree of opening of the idle speed control valve is controlled within the range between the fully opened position and the fully closed position in accordance with the engine coolant temperature when the engine coolant temperature is low, and the idle speed control valve is held at neutral position after the engine coolant temperature becomes sufficiently high. Therefore, the degree of opening of the idle speed control valve is set near the optimum value when the engine coolant temperature is low even if a failure occurs, and also excessively high engine idle speed can be prevented from occurring after the engine coolant temperature becomes high.

On the other hand, if a failure of the case 2, 3 or 4 in FIG. 8 occurs, the idle speed control valve is held at the neutral position when the engine coolant temperature is low in order to prevent the engine speed from decreasing excessively, and when the engine coolant temperature becomes sufficiently high, the degree of opening of the idle speed control valve is controlled within the range between the fully closed position and the neutral position in accordance with the engine coolant temperature.

Figure 11:
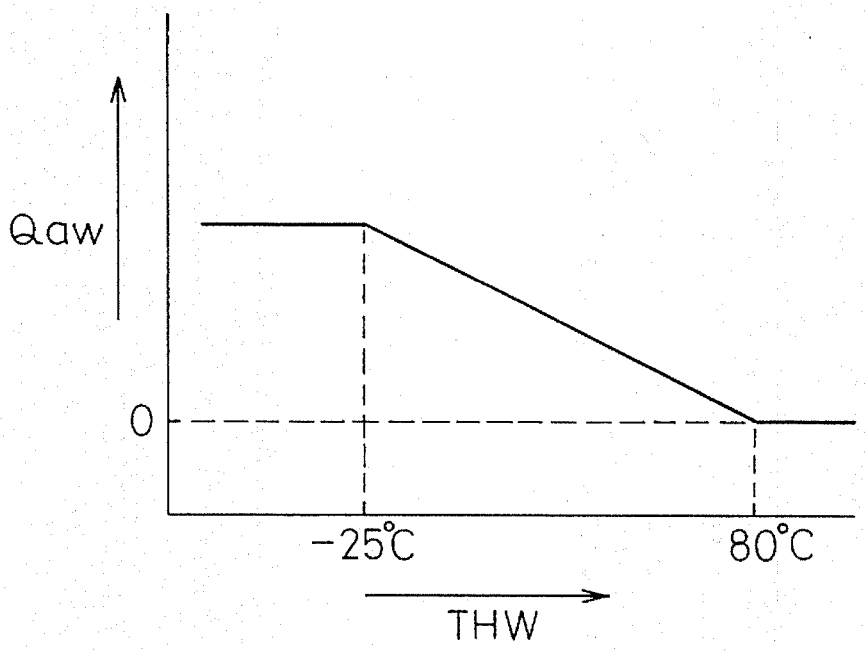
FIG. 11 is a graph showing the relationship between the set value for the amount of air flowing through the air bypass passage and engine cooling water temperature.

In order to achieve the control explained above, the amount Ga of bypass air is corrected by a correction amount Qaw, and the value (Ga–Qaw), instead of Ga, is used for the emergency control in this embodiment. In this embodiment, the amount Ga of bypass air is also calculated in the same manner as the embodiment in FIG. 9 when a failure of the solenoids occurs. The corrected amount Qaw is determined in accordance with the engine coolant temperature. FIG. 11 shows an example of the relationship between the correction amount Qaw and the engine coolant temperature THW. As shown in FIG. 11, the correction amount Qaw increases as the coolant temperature THW decreases, i.e., the amount Qaw changes in accordance with the coolant temperature THW in a similar manner as the optimum amount of bypass air.

Figure 12:
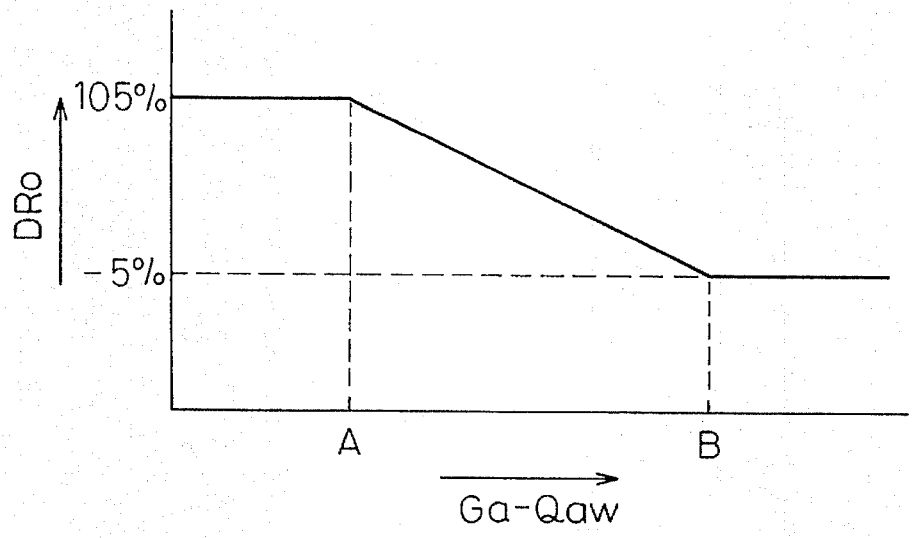
FIG. 12 is a graph showing an example of the set value for the duty ratio of the control signal when one of the solenoids fails.

Further, the duty ratio DR of the control signal is controlled so that it changes from 0% to 100% continuously in accordance with the value (Ga–Qaw) in this embodiment. FIG. 12 shows a target value $DR_0$ of the duty ratio DR set in accordance with the value (Ga–Qaw). As explained later, the actual value of the duty ratio DR is controlled in such a manner that the deviation of the DR from the target value $DR_0$ becomes less than a predetermined value.

As seen from FIG. 12, the target value $DR_0$ is set at 105% when the value (Ga–Qaw) is less than a predetermined value A. When the target value $DR_0$ is set at a value exceeding 100%, the value of the actual duty ratio DR is set at 100 %. Further, the target value $DR_0$ is set at –5% when the value (Ga–Qaw) is more than a predetermined value B. Similarly, the value of the actual duty ratio DR is set at 0% when the target value $DR_0$ is set at less than 0%. When the value (Ga–Qaw) is between A and B, the target value $DR_0$ changes from 105% to –5% continuously in accordance with the value (Ga–Qaw).

By setting the target value $DR_0$ as shown in FIG. 12, the correction amount Qaw is set at a larger value when the engine coolant temperature is low, and the degree of opening of the idle speed control valve (i.e., the target value $DR_0$ of the duty ratio DR) becomes large since the value (Ga–Qaw) becomes smaller. Since the value of the correction amount Qaw decreases as the engine coolant temperature becomes higher, the value (Ga–Qaw) increases, and the degree of opening of the idle speed control valve becomes smaller.

Figure 13:
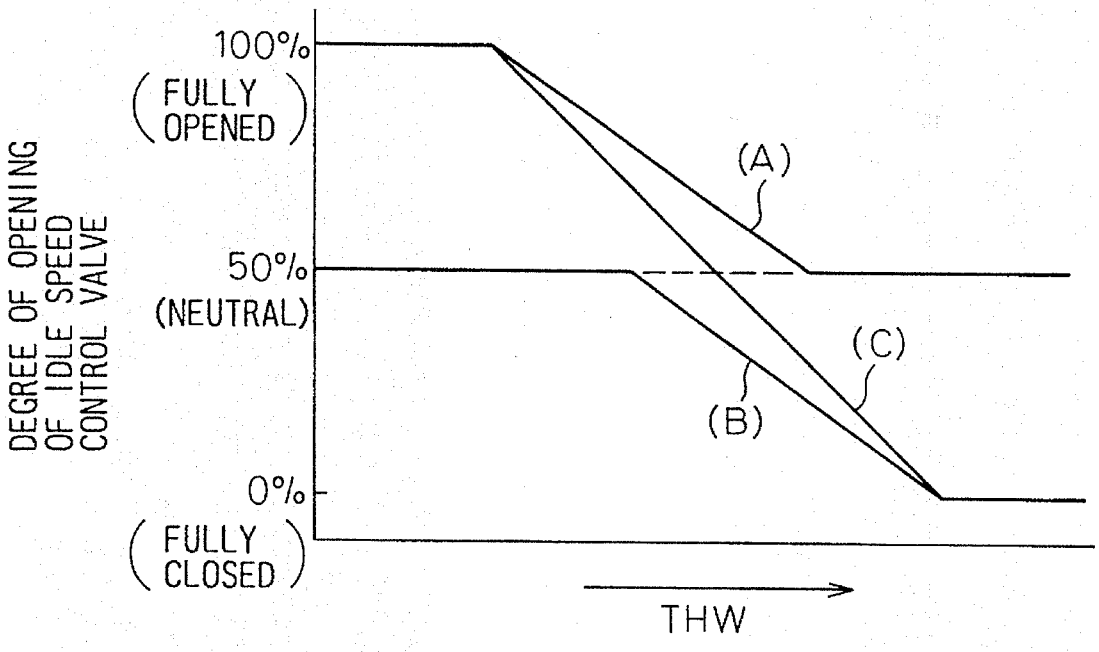
FIG. 13 is a graph showing the relationship between the degree of opening of the idle speed control valve and the engine cooling water temperature according to another embodiment of the present invention; and, FIG. 14 is a flowchart of the control routine for a two-solenoid rotary type idle speed control valve according to an embodiment of the present invention.

FIG. 13 illustrates the change in the degree of opening of the idle speed control valve according to the engine coolant temperature THW in this embodiment. The curve (A) in FIG. 13 shows the change in the degree of opening of the idle speed control valve when a failure of case 1, 5 or 6 in FIG. 8 occurs, and the curve (B) shows the same when a failure of case 2, 3 or 4 in FIG. 8 occurs. The curve (C) in FIG. 13 represents the degree of opening of the idle speed control valve required for obtaining the optimum amount of bypass air.

As explained before, when a failure of the case 1, 5 or 6 occurs, the degree of opening of the idle speed control valve can be controlled only in the range between the fully opened valve position and the neutral valve position. In this embodiment, as shown by the curve (A) in FIG. 13, the degree of opening of the idle speed control valve is controlled when one a failure of the case 1, 5 or 6 occurs in such a manner that when the engine temperature is low, the degree of opening of the idle speed control valve gradually decreases from the fully opened position as the engine coolant temperature THW increases and reaches the neutral valve position at a certain engine coolant temperature, and thereafter, the degree of opening of the idle speed control valve is maintained at the neutral valve position regardless of the increase of the engine coolant temperature. It will be understood by comparing the curves (A) and (C) that the degree of opening of the idle speed control valve when a failure of the case 1, 5 or 6 in FIG. 8 occurs is set near the optimum curve (C) in the low temperature range of the engine coolant.

On the other hand, when a failure of the case 2, 3 or 4 in FIG. 8 occurs, the degree of opening of the idle speed control valve can be controlled only in the range between the fully closed valve position and the neutral valve position. In this case, as shown by the curve (B) in FIG. 13, the degree of opening of the idle speed control valve is controlled in such a manner that the degree of opening of the idle speed control valve is maintained at the neutral position when the engine coolant temperature is low, and after the engine coolant temperature THW becomes higher than a certain value, the degree of opening of the idle speed control valve gradually decreases from the neutral position as the engine coolant temperature THW increases. Therefore, the degree of opening of the idle speed control valve in this case is set near the optimum curve (C) in the high temperature range of the engine coolant.

Figure 14:
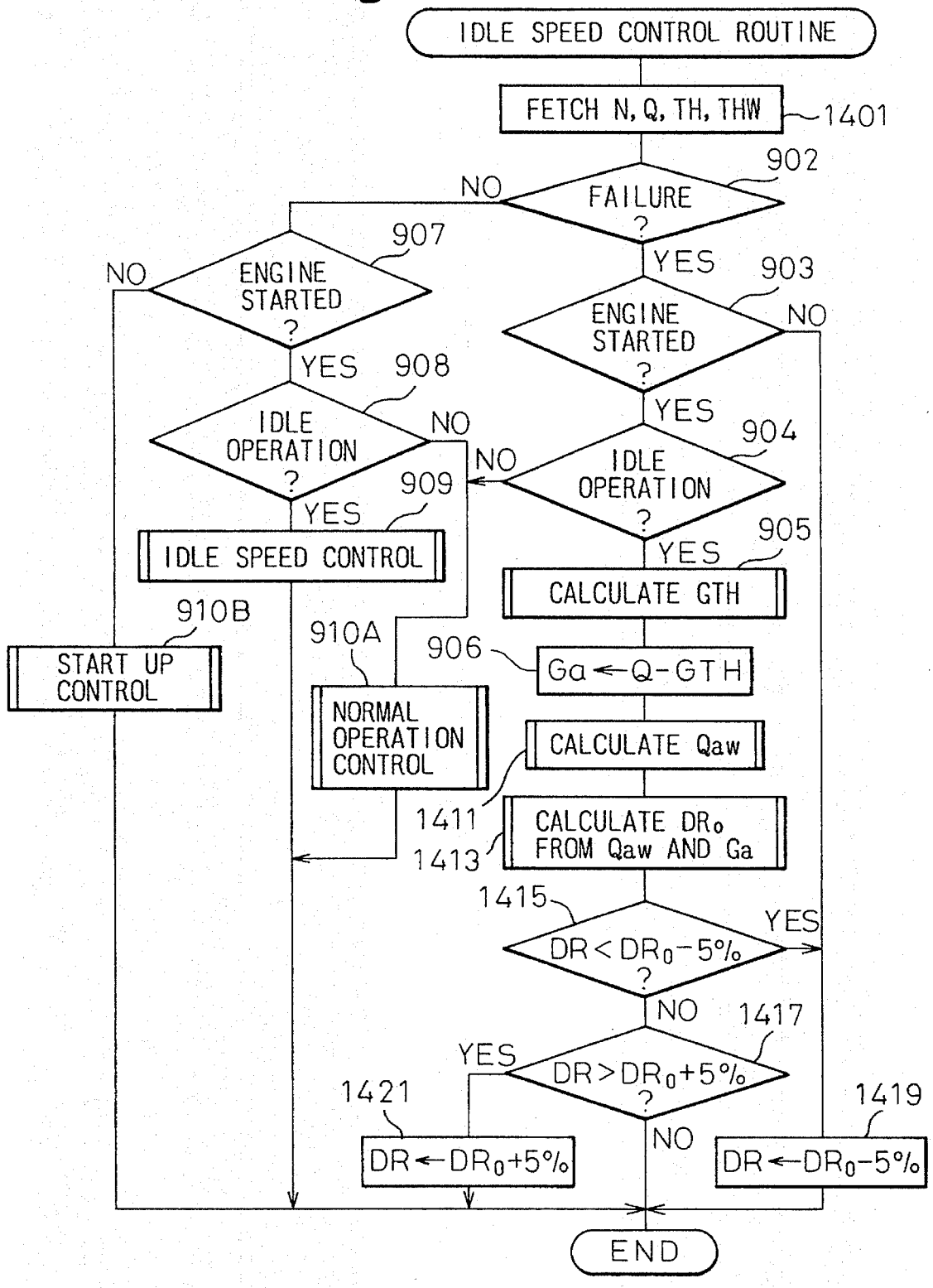

FIG. 14 is a flowchart illustrating the emergency control routine of the idle speed control valve in this embodiment. This routine is performed by the ECU 110 at predetermined intervals. Since some of the steps in FIG. 14 are the same as the steps in FIG. 9, only the steps different from those in FIG. 9 are explained hereinafter.

When the routine starts in FIG. 14, the signals representing the engine speed N, the amount of intake air flow Q and the degree of opening TH of the throttle valve 103 are input from the corresponding sensors 120, 121 and 122, at step 1401. In this embodiment, further the signal representing the engine coolant temperature THW is input from a coolant temperature sensor 141 disposed on the coolant passage of the engine cylinder block at step 1401. After executing step 1401, the routine executes steps 902 through 910A in which the determining of the failure and the calculation of the amount Ga of bypass air are performed. These steps are identical to those in FIG. 9, and already explained before.

After executing these steps, the routine proceeds to step 1411 which determines the correction amount Qaw based on the coolant temperature THW read at step 901 and the relationship shown in FIG. 11. The relationship shown in FIG. 11 is stored in the ROM 112 of the ECU 110 in the form of a numerical table based on the values of THW and Qaw. After determining the value of Qaw, at step 1413, the target value $DR_0$ of the duty ratio is determined from the values Qaw and Ga using the relationship shown in FIG. 12. The relationship in FIG. 12 is also stored in the ROM 112 of the ECU 110 in the form of a numerical table based on the values $DR_0$ and (Ga–Qaw).

After determining the target value $DR_O$, it is determined at steps 1415 and 1417, whether the deviation of the present value of the actual duty ratio DR from the target value $DR_0$ is less than or equal to 5%.

If $DR<DR_0-5\%$ at step 1415, the value of the actual duty ratio DR is set at $(DR_0-5\%)$ at step 1419, and if $DR>DR_0+5\%$, at step 1417, the value of the actual duty ratio DR is set at $(DR_0+5\%)$ at step 1421. On the other hand, if actual value of the duty ratio DR of the control signal is $(DR_0-5\%)\leqq DR\leqq(DR_0+5\%)$ at steps 1415 and 1417, the present value of the duty ratio DR is maintained. Namely, the actual duty ratio DR is set within a tolerance of ±5% from the target value $DR_0$ to prevent the degree of opening of the idle speed control valve from being frequently changed by small fluctuations in the amount Ga of bypass air.

From above explanation, it will be understood that the present invention provides a device which can control the idle speed control valve so that the amount of bypass air is maintained in an appropriate range even if a failure of the solenoids occurs.

However, though the present invention has been described with reference to specific embodiments selected for the purpose of illustration, it should be understood that numerous modifications could be applied by those skilled in the art without departing from the basic concept and scope of the present invention.

For example, in the embodiments in FIGS. 9 and 14, the emergency control of the idle speed control valve is performed without determining the type of the failure. However, if desired, it is possible to differentiate the failures of cases 3 and 6 (source short-circuiting) from other types of failures. Namely, when one of the voltages of the monitoring points oscillates while the voltage of the other monitoring points becomes constant, and if the voltage at latter is constant at the output voltage of the battery, it is considered that the failure is caused by a source short-circuiting. Therefore, in this case, the idle speed control valve may be held at the neutral position by cutting the electric supply to both the solenoids.

Further, though the amount of inlet air flow Q is detected by the airflow meter 121 disposed on the inlet air passage 101 in the embodiment explained above, the inlet air flow Q may be determined by engine operating parameters such as an inlet manifold pressure and the engine speed. In this case, the amount of inlet air flow Q is measured previously under various engine speeds and inlet manifold pressures, and stored in the ROM 112 in the ECU 110 in the form of a numerical table based on the values of the inlet manifold pressure and the engine speed.

We claim:

1. An idle speed control device for an engine having an inlet air passage and a throttle valve disposed thereon, comprising:

an inlet air bypass passage connecting the portions of the inlet air passage upstream and downstream of the throttle valve for supplying inlet air to the engine without passing through the throttle valve;

a two-solenoid rotary type idle speed control valve disposed on said inlet air bypass passage having an opening solenoid for urging said valve to open and a closing solenoid for urging said valve to close;

a bypass air control means for controlling the opening of said idle speed control valve by adjusting the electric current supplied to said opening solenoid and said closing solenoid in such a manner that the idle speed of the engine coincides with a predetermined target speed;

a failure detecting means for detecting the failure of said solenoids;

a bypass air flow detecting means for detecting the amount of air flowing through the inlet air bypass passage when the failure of the either of the solenoids is detected; and, an emergency control means for maintaining the degree of opening of said idle speed control valve within a predetermined range when one of the solenoids fails, by adjusting the electric current supplied to the other solenoid in accordance with the amount of air flow detected by said bypass air flow detecting means.

2. An idle speed control device according to claim 1, wherein said emergency control means adjusts the electric current supplied to said other solenoid at either of the values which maintains said control valve fully open or fully closed in the normal condition of the solenoids in accordance with the amount of air flow detected by said bypass air flow detecting means.

3. An idle speed control device according to claim 1, wherein said emergency control means comprises, a correcting means for correcting the amount of air flow detected by said bypass air flow detecting means based on the operating condition of the engine, and a means for adjusting the electric current supplied to said other solenoid continuously between the values corresponding to the fully opened condition and fully closed condition of said control valve in the normal condition of the solenoids in accordance with the amount of air flow after it is corrected by said correcting means.

4. An idle speed control device for an engine having an inlet air passage and a throttle valve disposed thereon, comprising:

an inlet air bypass passage connecting the portions of the inlet air passage upstream and downstream of the throttle valve for supplying inlet air to the engine without passing through the throttle valve;

a two-solenoid rotary type idle speed control valve disposed on said inlet air bypass passage having an opening solenoid for urging said valve to open and a closing solenoid for urging said valve to close;

a bypass air control means for generating a control signal which controls the degree of opening of said idle speed control valve in such a manner that the idle speed of the engine coincides with a predetermined target speed;

a drive means for driving said idle speed control valve by supplying electric current to said opening solenoid and said closing solenoid in accordance with said control signal;

a failure detecting means for detecting the failure of said solenoids;

a bypass air flow detecting means for detecting the amount of air flowing through the inlet air bypass passage when the failure of the either of the solenoids is detected; and, an emergency control means for controlling said bypass air control means when one of the solenoids fails in such a manner that said bypass air control means generates said control signal in accordance with the amount of air flow detected by said bypass air flow detecting means.

5. An idle speed control device according to claim 4, wherein said emergency control means controls said bypass air control means in such a manner that said bypass air control means generates either a control signal for fully opening said idle speed control valve or a control signal for fully closing said idle speed control valve in accordance with the amount of air flow detected by said bypass air flow detecting means when one of the solenoids fails.

6. An idle speed control device according to claim 4, wherein said emergency control means comprises, a correcting means for correcting the amount of air flow detected by said bypass air flow detecting means based on the operating condition of the engine, and a means for controlling said bypass air control means in such a manner that said bypass air control means generates said control signal continuously changing between the value for fully opening said idle speed control valve and the value for fully closing said idle speed control valve in accordance with the amount of air flow after it is corrected by said correcting means when one of the solenoids fails.

* * * * *